United States Patent [19]

Iwai et al.

[11] Patent Number: 5,021,106

[45] Date of Patent: Jun. 4, 1991

[54] BRAZEABLE ALUMINUM ALLOY SHEET AND PROCESS OF MAKING SAME

[75] Inventors: Ichiro Iwai; Hiroyuki Eda, both of Tochigi, Japan

[73] Assignee: Showa Aluminum, Osaka, Japan

[21] Appl. No.: 424,083

[22] Filed: Oct. 19, 1989

[30] Foreign Application Priority Data

Oct. 21, 1988 [JP] Japan ..... 63-266874
Oct. 21, 1988 [JP] Japan ..... 63-266875
Apr. 28, 1989 [JP] Japan ..... 1-110641

[51] Int. Cl.[5] ..... C22C 21/00; C22F 1/04

[52] U.S. Cl. ..... 148/437; 148/2; 148/11.5 A; 420/540; 420/548

[58] Field of Search ..... 420/540, 548; 148/2, 148/11.5 A, 437

[56] References Cited

U.S. PATENT DOCUMENTS 3,859,058 1/1975 Anthony et al. ..... 428/629
3,878,871 4/1975 Anthony et al. ..... 420/534
3,923,557 8/1975 Anthony et al. ..... 420/535
4,334,935 6/1982 Morris ..... 148/437
4,906,534 3/1990 Bekki et al. ..... 428/654

FOREIGN PATENT DOCUMENTS 0365367 4/1990 European Pat. Off. .
60-33346 2/1985 Japan ..... 148/11.5 A
61-104042 5/1986 Japan .
62-80246 4/1987 Japan .
62-86150 4/1987 Japan .
62-158850 7/1987 Japan .

*Primary Examiner*—R. Dean
*Assistant Examiner*—David W. Schumaker
*Attorney, Agent, or Firm*—Tilton, Fallon, Lungmus & Chestnut

[57] ABSTRACT

A brazeable aluminum alloy sheet consisting essentially of 0.8 to 1.3 wt % of Mn, 0.2 to 0.7 wt % of Si, one or two of 0.04 to 0.1 wt % of In and 0.1 to 2.0 wt % of Zn, the balance being aluminum and unavoidable impurities. The brazeable aluminum alloy sheet is produced by a process which comprises preparing an ingot of aluminum alloy containing 0.8 to 1.3 wt % of Mn and 0.2 to 0.7 wt % of Si, the balance being aluminum and unavoidable impurities, hot rolling the aluminum mass at a temperature of 350° to 450° C. without conducting a homogenizing treatment, conducting a first part of cold rolling on the hot rolled aluminum alloy, conducting a process annealing on the aluminum alloy at a temperature of 350° to 420° C., and conducting a second part of cold rolling on the annealed aluminum alloy at a draft percentage of 20 to 40%.

2 Claims, No Drawings

BRAZEABLE ALUMINUM ALLOY SHEET AND PROCESS OF MAKING SAME

BACKGROUND OF THE INVENTION

The present invention relates to a brazeable aluminum alloy sheet and a process of making same. More particularly, the present invention relates a brazeable aluminum alloy sheet for making fins for heat exchangers such as condensers, evaporators, radiators and coolers particularly for automobiles.

It is known in the art that the fins of heat exchangers are made of Al-Mn alloy sheets or brazing sheets having cores of the Al-Mn alloy sheets coated with a Al-Si brazing agent on both sides or on one side. The fins and the tubular elements are brazed to each other.

Recently there have been strong demands for lightweight vehicles and the reduced production cost. To meet these demands thin sheets are made but the thin sheets are likely to deform, that is, to bend under load and to buckle when they are subjected to brazing heat. It is therefore essential that the thin sheets must have an anti-deflection ability without trading off the formability. In order to be anti-deflectable, their heat resistance must be increased, and also it is required that the crystals in the sheet texture grow fully owing to recrystallization at the brazing heat. The growth of crystals increases the heat resistance of the sheets. If the crystals are small, the grain boundaries increase which introduces a molten brazing agent into the depth of the sheet texture, thereby allowing it to erode the sheet texture from inside. As a result, the sheets lose their strength. In contrast, the large crystals reduce crystal boundaries, thereby preventing the molten brazing agent from eroding the sheet texture.

It has been found through the long period of use that the Al-Mn alloy sheet lacks sufficient anti-deformation ability.

To improve this drawback one prior art example teaches that one or two of Si, Sn, Zn, Mg, and Zr are added to the Al-Mn alloy (for example, Japanese Patent Kokai (unexamined) No. 63-125635). Another example teaches that one or two of the high melting point metals in the Va and VIa families such as Ta, Nb, Mo and W are added thereto (Japanese Patent Kokai (unexamined) No. 63-125636). A further example teaches that the final working in the cooling period after annealing is controlled to improve the production process (Japanese Patent Kokai No. 63-125635). However, there has been no successful expedient which satisfies the strong demand for thin fins.

In order to increase the corrosion resistance of tubular elements for heat exchangers, In or Zn is added to make the fins sacrificial anodes. However, the addition of In and Zn decreases the anti-deflection ability of the sheets.

OBJECTS AND SUMMARY OF THE INVENTION

Accordingly, an object of the present invention is to provide an aluminum alloy having an increased anti-deflection ability.

Another object of the present invention is to provide an aluminum alloy sheet having the effect of a sacrificial anode.

A further object of the present invention is to provide a process of producing an aluminum alloy having an increased anti-deflection ability.

According to one aspect of the present invention there is provided a brazeable aluminum alloy sheet comprising 0.8 to 1.3 wt % of Mn and 0.2 to 0.7 wt % of Si, the balance being aluminum and unavoidable impurities.

According to another aspect of the present invention there is provided a brazeable aluminum alloy sheet consisting essentially of 0.8 to 1.3 wt % of Mn, 0.2 to 0.7 wt % of Si, one or two of 0.04 to 0.1 wt % of In and 0.1 to 2.0 wt % of Zn, the balance being aluminum and unavoidable impurities, thereby allowing the sheet to have the effect of sacrificial anode.

According to a further aspect of the present invention there is provided a process of making a brazeable aluminum alloy sheet, the process comprising preparing an ingot of aluminum alloy containing 0.8 to 1.3 wt % of Mn and 0.2 to 0.7 wt % of Si, the balance being aluminum and unavoidable impurities, hot rolling the aluminum mass at a temperature of 350° to 450° C. without conducting a homogenizing treatment, conducting a first part of cold rolling on the hot rolled aluminum alloy, conducting a process annealing on the alloy at a temperature within the range of 350° to 420° C., and conducting a second part of cold rolling on the annealed alloy at a draft percentage of 20 to 40%.

According to a still further aspect of the present invention there is provided a process of making a brazeable aluminum alloy sheet, the process comprising preparing an ingot of aluminum alloy containing 0.8 to 1.3 wt % of Mn, 0.2 to 0.7 wt % of Si, one or two of 0.04 to 0.1 wt % of In and 0.1 to 2.0 wt % of Zn, the balance being aluminum and unavoidable impurities, hot rolling the aluminum mass at a temperature of 350° to 450° C. without conducting a homogenizing treatment, conducting a first part of cold rolling on the hot rolled aluminum alloy, conducting a process annealing on the alloy at a temperature within the range of 350° to 420° C., and conducting a second part of cold rolling on the annealed alloy at a draft percentage of 20 to 40%.

Other objects and advantages of the present invention will become more apparent from the following detailed description, when taken in conjunction with the examples which show, for the purpose of illustration only, one embodiment in accordance with the present invention.

DETAILED DESCRIPTION OF PREFERRED EMBODIMENTS OF THE INVENTION

Mn (manganese) increases the room temperature strength of alloy, and produces Al-Mn-Si base fine precipitates through the reaction of it with Al and Si. The fine precipitates advantageously retard the recrystallization, so that the resulting crystals grow enough to increase the anti-deflection ability of the alloy. However if Mn is less than 0.8 wt %, no substantial effect results. Whereas, if it exceeds 1.3 wt %, coarse precipitates are produced which decrease the formability, and become cores in recrystalline crystals to divide them into too fine grains. As a result, the high temperature strength of alloy and the anti-deflection ability decrease because of the erosion of the sheet texture by the brazing agent.

Si (silicon) produces Al-Mn-Si base fine precipitates, and serves to recrystallize in large crystals. However, if Si is less than 0.2 wt %, no substantial effect results.

Whereas, if it exceeds 0.7 wt %, coarse precipitates result, thereby making it difficult to obtain large recrystalline crystals.

In (indium) and Zn (zinc) are particularly of advantage when they are added to the sheet used for fins of heat exchanger, because they provide cathodic protection to the tubular elements by causing the fins to act as sacrificial anodes. For this use In and Zn are equivalents, and the alternative use of it suffices. However, if In is less than 0.04 wt %, and Zn is less than 0.1 wt % no substantial effect results. Whereas, if In exceeds 0.1 wt %, and Zn exceeds 2.0 wt % the anti-deflection ability of the alloy decreases.

In addition, Zr (zirconium) and Cr (chromium) can be added. These elements are effective to increase the formability and anti-deflection ability of the alloy. For this use Zr and Cr are equivalents, and the alternative use of it suffices. However, if the total amount of them is less than 0.04 wt % no substantial effect results, but if it exceeds 0.12 wt %, coarse precipitates result, thereby leading to excessively fine recrystalline grains.

In addition to the above-mentioned elements, impurities are unavoidably contained, wherein the impurities include Fe (iron), Cu (copper), Mg (magnesium), Cr (chromium), Zn (zinc) and Ti (titanium). Fe produces Al-Fe base and Al-Mn-Fe base coarse precipitates, and make cores for recrystallization. This leads to fine recrystalline grains, and not only decreases the high temperature strength of alloy but also allows the brazing agent to erode the sheet texture when brazing is practised. Preferably the amount of Fe is not greater than 0.3 wt %. Cu, when the alloy sheets are used as fins for heat exchanger, tends to decrease the corrosion resistance thereof by making the fins at positive potential for the tubular elements. Preferably the amount of Cu is not greater than 0.05 wt %.

It is preferred to adjust that recrystallizing crystals grow at a brazing heat of about 600° C. so as to be not smaller than 200 μm in average diameter, and the ratio (l/d) of the length (l) of crystals in a rolling direction to the thickness (d) thereof is not smaller than 20. If the average diameter of recrystalline grain is smaller than 200 μm, it is difficult to enhance the high temperature strength. What is worse, the invasion of a molten brazing agent accelerates the Si erosion through grains in the sheet textures. As a result, the anti-deformation ability of the alloy sheet decreases. The ratio l/d is an aspect ratio, and the reason why it should be not smaller than 20 is that if it is smaller than 20, it is difficult to enhance the high temperature strength of the sheet. Preferably the ratio l/d is 25 or more.

Now, a process of producing the brazeable aluminum alloy sheet will be described:

The features of the process according to the present invention are twofold: one is that the sheets are not subjected to substantial heat until they are subjected to the brazing heat at an assembly stage, thereby preventing the Mn content from growing into large precipitates, which otherwise would make cores for recrystallization, and the other is that the draft percentage in the final rolling is controlled to such an optimum range as to restrain the driving force for recrystallization.

More specifically, aluminum containing the above-mentioned elements is melted and cast into an ingot. Then the ingot is hot rolled into sheets, without conducting a homogenizing treatment. The reason why the homogenizing process is omitted is that if it is practised Mn is formed as an Al-Mn or Al-Mn-Fe-base coarse precipitate, and makes cores in the recrystallization, thereby leading to fine recrystalline grains. The hot rolling is carried out at a temperature within the range of 350° to 450° C. so as to avoid the formation of coarse precipitates.

Subsequently, the hot rolled sheets are cold rolled, without conducting a process annealing between the hot rolling and the cold rolling. The cold rolling process is divided into two parts; the first part and the second part. Between the two parts of the cold rolling a process annealing is practised at a temperature within the range of 350° to 420° C. The reason why the process annealing is carried out between the hot rolling and the cold rolling is that if it is practised, coarse precipitates are formed. The process annealing between the first part and the second part of cold rolling is to relieve strain of the sheet so as to facilitate the rolling and to control the draft percentage in the second part of cold rolling. The optimum range is 350° to 420° C. for the process annealing. If it is less than 350° C., no substantial effect results, whereas if it is more than 420° C., coarse precipitates are produced, thereby leading to too fine recrystallized grains. As a result, the anti-deflection ability decreases. The draft percentage in the second part of the cold rolling is preferably 20 to 40%. If it is less than 20%, no recrystallization occurs, and the crystals remain unstable when the brazing is practised. This allows a molten brazing agent to invade into the texture of the sheet through the grain boundaries and erode the sheet texture. If it exceeds 40%, the driving force for recrystallization becomes too large, and the crystals become divided, which allow the molten brazing agent to erode the texture of the sheet. The second part of cold rolling determines the final thickness of the sheets. The conditions for the first part of cold rolling are not specified but the conditions for ordinary cold forging can be adopted. When the sheets are used as cores for aluminum brazing sheets, the sheets can be coated with a brazing agent on both side or on one side in the hot rolling process.

EXAMPLE (1)

Brazing sheets were prepared as specimens (A) to (M) for the present invention and specimens (N) and (O) for comparison each of which contained a core of Al alloy sheet having the compositions shown in Table (1). The process of preparing the specimens was as follows:

With each specimen an aluminum alloy was melted and cast into an ingot. The ingot was chamfered without the interposition of a homogenizing process. The chamfered ingot was coated with a brazing agent of Al-Si alloy by 15% on both sides, and was hot rolled to the thickness of 3.2 mm. Then the sheet was subjected to a first part of cold rolling until it was extened to the thickness of 0.2 mm without a process annealing on the sheet. Then the sheet was annealed at 370° C. for an hour, and then subjected to a second part of cold rolling until the sheet has a thickness of 0.13 mm. The draft percentage in the second part of cold rolling was 35%.

TABLE 1

| Specimen | Composition (wt %) | | | | | | | | |
|---|---|---|---|---|---|---|---|---|---|
| No. | Mn | Si | In | Zn | Cr | Zr | Fe | Cu | Al |
| A | 0.98 | 0.64 | — | — | — | — | 0.15 | 0.07 | Bal. |
| B | 0.83 | 0.22 | — | — | — | — | 0.16 | 0.031 | Bal. |
| C | 1.14 | 0.38 | — | — | — | — | 0.23 | 0.024 | Bal. |

TABLE 1-continued

| Specimen No. | Composition (wt %) Mn | Si | In | Zn | Cr | Zr | Fe | Cu | Al |
|---|---|---|---|---|---|---|---|---|---|
| D | 0.88 | 0.46 | — | — | 0.07 | — | 0.16 | 0.008 | Bal. |
| E | 1.09 | 0.53 | — | — | — | 0.10 | 0.21 | 0.033 | Bal. |
| F | 1.26 | 0.41 | — | — | 0.04 | 0.05 | 0.15 | 0.019 | Bal. |
| G | 0.96 | 0.64 | 0.073 | — | — | — | 0.15 | 0.007 | Bal. |
| H | 0.83 | 0.22 | — | 0.24 | — | — | 0.16 | 0.031 | Bal. |
| I | 0.92 | 0.35 | — | 1.56 | — | — | 0.18 | 0.015 | Bal. |
| J | 1.14 | 0.38 | 0.04 | 0.88 | — | — | 0.23 | 0.024 | Bal. |
| K | 0.88 | 0.46 | — | 1.15 | 0.07 | — | 0.16 | 0.008 | Bal. |
| L | 1.09 | 0.53 | 0.093 | — | — | 0.10 | 0.21 | 0.033 | Bal. |
| M | 1.26 | 0.41 | 0.067 | 1.02 | 0.04 | 0.05 | 0.15 | 0.019 | Bal. |
| N | 1.50 | 0.88 | — | — | — | — | 0.23 | 0.02 | Bal |
| O | 0.57 | 0.13 | — | — | — | — | 0.27 | 0.06 | Bal. |

(Note)
Specimens A to M are for the present invention.
Specimens N and O are for the comparison.
Fe and Cu are contained as impurities.

The specimens A to O were tested with respect to their anti-deflection ability and corrosion resistance. In addition, they were examined on their formability when they were used for making corrugated louver fins having a height of 12 mm, a width of 50 mm and a pitch of 10 mm. The anti-deflection test was conducted by cutting each specimen into a bar having a length of 80 mm and a width of 20 mm, and supporting a part of it which is 35 mm from one end while the remaining part of 45 mm is projected in a free manner, i.e. with no support, and applying a load on the projecting longer part to measure the amount of deflection. In addition, recrystalline grain sizes (diameter) after heating, and l/d (aspect ratio) were measured, wherein l was the length of individual crystals in a rolling direction and d was the thickness thereof. The corrosion resistance test was conducted by brazing each specimen to a tubular element of aluminum alloy AA1100, applying a salt spray (salt spray corrosion test) and measuring a period of time until a leakage develops in the tubular element. The results are shown in Table (2):

TABLE 2

| Alloys | Anti-Deflection (mm) | Formability | Grain Size (μm) | l/d | Corrosion Resistance (hour) |
|---|---|---|---|---|---|
| A | 7 | Good | 280 | 35 | 3000 to 3500 |
| B | 7 | Good | 300 | 34 | 3000 to 3500 |
| C | 6 | Good | 300 | 36 | 3000 to 3500 |
| D | 5 | Good | 280 | 40 | 3000 to 3500 |
| E | 4 | Good | 320 | 42 | 3000 to 3500 |
| F | 4 | Good | 300 | 42 | 3000 to 3500 |
| G | 9 | Good | 280 | 30 | 6000 or more |
| H | 8 | Good | 250 | 30 | 6000 or more |
| I | 9 | Good | 260 | 27 | 6000 or more |
| J | 8 | Good | 280 | 29 | 6000 or more |
| K | 7 | Good | 300 | 33 | 6000 or more |
| L | 6 | Good | 260 | 36 | 6000 or more |
| M | 7 | Good | 250 | 33 | 6000 or more |
| N | 12 | Poor | 250 | 20 | 3000 to 3500 |
| O | 20 | Good | 150 | 15 | 3000 to 3500 |

(Note)
Specimens A to M are for the present invention.
Specimens N and O are for the comparison.

EXAMPLE (2)

In Table (3) the letters (A) to (M) indicate the same composition contained in the specimens as that of the specimen marked the same letter in Table (1). The alloy was melted and cast into an ingot, and some ingots were not homogenized and others were homogenized. Then each ingot was chamfered, and coated with a brazing agent of Al-Si alloy by 15% on both sides. The ingot was hot rolled to the thickness of 3.2 mm, and some were annealed while the others were not. The annealed and unannealed sheets were subjected to a first cold rolling until they have a thickness of 0.2 mm. Then the process annealing and a second cold rolling were applied to the sheets. The details about the processes of obtaining each specimen are shown in Table (3).

Each specimen was examined in the same manner as Example (1) with respect to anti-deflection ability, corrosion resistance and formability. The results are shown in Table (3):

TABLE 3

| Spec. No. | Alloy | Homog. | H.R. (C°) | Int. Ann. (C° × hour) | Thickness (mm) | Pro. Ann. (C° × hour) | Draft (%) | Anti-Def. (mm) | Forma. | Corr. Res. (hour) |
|---|---|---|---|---|---|---|---|---|---|---|
| 1 | A | nil | 370 | nil | 0.2 | 400 × 1 | 22 | 8 | good | 3000-3500 |
| 2 | B | nil | 390 | nil | 0.2 | 370 × 1 | 36 | 7 | good | 3000-3500 |
| 3 | C | nil | 395 | nil | 0.2 | 415 × 1 | 28 | 6 | good | 3000-3500 |
| 4 | D | nil | 400 | nil | 0.2 | 370 × 1 | 30 | 5 | good | 3000-3500 |
| 5 | E | nil | 420 | nil | 0.2 | 385 × 1 | 24 | 3 | good | 3000-3500 |
| 6 | F | nil | 445 | nil | 0.2 | 355 × 1 | 35 | 4 | good | 3000-3500 |
| 7 | G | nil | 370 | nil | 0.2 | 400 × 1 | 22 | 10 | good | 6000-more |
| 8 | H | nil | 390 | nil | 0.2 | 370 × 1 | 36 | 8 | good | 6000-more |
| 9 | I | nil | 395 | nil | 0.2 | 415 × 1 | 28 | 10 | good | 6000-more |
| 10 | J | nil | 400 | nil | 0.2 | 370 × 1 | 30 | 8 | good | 6000-more |
| 11 | K | nil | 420 | nil | 0.2 | 385 × 1 | 24 | 8 | good | 6000-more |
| 12 | L | nil | 445 | nil | 0.2 | 355 × 1 | 35 | 7 | good | 6000-more |
| 13 | M | nil | 400 | nil | 0.2 | 370 × 1 | 35 | 6 | good | 6000-more |
| 14 | A | appl. | 370 | nil | 0.2 | 380 × 1 | 45 | 35 | good | 3000-3500 |
| 15 | B | nil | 495 | 370 × 1 | 0.2 | 370 × 1 | 28 | 17 | good | 3000-3500 |
| 16 | D | nil | 380 | 370 × 1 | 0.2 | 440 × 1 | 30 | 15 | good | 3000-3500 |
| 17 | F | appl. | 400 | 370 × 1 | 0.2 | 370 × 1 | 30 | 40 | good | 3000-3500 |
| 18 | G | appl. | 370 | nil | 0.2 | 380 × 1 | 45 | 38 | good | 6000-more |
| 19 | H | nil | 495 | 370 × 1 | 0.2 | 370 × 1 | 28 | 17 | good | 6000-more |
| 20 | J | nil | 380 | 370 × 1 | 0.2 | 440 × 1 | 30 | 16 | good | 6000-more |

TABLE 3-continued

| Spec. No. | Alloy | Homog. | H.R. (C°) | Int. Ann. (C° × hour) | Thickness (mm) | Pro. Ann. (C° × hour) | Draft (%) | Anti-Def. (mm) | Forma. | Corr. Res. (hour) |
|---|---|---|---|---|---|---|---|---|---|---|
| 21 | M | appl. | 400 | 370 × 1 | 0.2 | 370 × 1 | 30 | 35 | good | 6000–more |

(Note)
Homog. stands for homogenizing.
H.R. stands for hot rolling.
Pro. Ann. stands for process annealing.
Thickness means that of each sheet after the first part of cold rolling.
Draft means the draft percentages of core sheets in the second part of cold rolling.
Anti-Def. stands for anti-deflection ability.
Forma. stands for formability.
Corr. Res. stand for corrosion resistance.

It will be appreciated from the results of Examples (1) and (2) that the brazeable aluminum alloy sheets have an enhanced anti-deflection ability without decreasing its formability.

What is claimed is:

1. A brazeable aluminum alloy sheet consisting essentially of 0.8 to 1.3 wt % of Mn and 0.2 to 0.7 wt % of Si, the balance being aluminum and unavoidable impurities, said aluminum alloy sheet containing recrystallized grains of not smaller than 200 μm in diameter, each recrystallized grain having a length of l in a rolling direction and a thickness of d wherein l/d is not smaller than 20.

2. A brazeable aluminum alloy sheet consisting essentially of 0.8 to 1.3 wt % of Mn, 0.2 to 0.7 wt % of Si, a member selected from the class consisting of (a) 0.04 to 0.1 wt % of In, (b) 0.1 to 2.0 wt % of Zn, and (c) 0.04 to 0.1 wt % of In and 0.1 to 2.0 wt % of Zn, the balance being aluminum and unavoidable impurities, thereby allowing the sheet to function as a sacrificial anode, said aluminum alloy sheet containing recrystallized grains of not smaller than 200 μm in diameter, each recrystallized grain having a length of l in a rolling direction and a thickness of d wherein l/d is not smaller than 20.

* * * * *